United States Patent [19]

Lueker et al.

[11] Patent Number: 4,504,809

[45] Date of Patent: Mar. 12, 1985

[54] MINIATURE THERMOMAGNETIC RELAY

[76] Inventors: Jonathan C. Lueker, 12225 NW. Big Fir Ct., Portland, 97229; Raymond A. Zandonatti, 11680 SW. Denfield, Beaverton, both of Oreg. 97005

[21] Appl. No.: 610,359

[22] Filed: May 15, 1984

Related U.S. Application Data

[63] Continuation of Ser. No. 449,036, Dec. 13, 1982, abandoned.

[51] Int. Cl.[3] ..... H01H 51/00

[52] U.S. Cl. ..... 335/208; 335/146

[58] Field of Search ..... 335/208, 146

[56] References Cited

U.S. PATENT DOCUMENTS 3,760,310 9/1973 Carson ..... 335/208

4,414,519 11/1983 Anderson ..... 335/208

*Primary Examiner*—Harold Broome

[57] ABSTRACT

A miniature latching thermomagnetic relay is disclosed which offers high contact forces, small size, and low cost. Ferromagnetic material is placed upon heaters in a low thermal conductivity substrate. A permanent magnet beneath the substrate attracts a moving element above the substrate. Contact points on the substrate and the moving element from electrical connections.

A control signal causes a heater to warm the ferromagnetic material, changing the saturation flux density of the material. This results in an unbalanced force on the moving element, causing it to rock about a pivot point to open or close connections as desired. Planar fabrication techniques may be used to construct the relay.

7 Claims, 4 Drawing Figures

MINIATURE THERMOMAGNETIC RELAY

This application is a continuation of application Ser. No. 449,036 filed Dec. 13, 1982, now abandoned.

BACKGROUND OF THE INVENTION

An ideal miniature relay would provide small size, high reliability in operation, and low cost of manufacture. However, accomplishing all three of these design goals simultaneously has proven to be difficult in the prior art. Many different types of miniature relay designs have been suggested, including piezoelectric, electrostatically deflected beam, thermally deflected beam, and printed coil magnetic designs. To reduce manufacturing costs to a minimum and to provide small size, planar fabrication techniques are exploited to the greatest extent possible in these designs.

A primary difficulty with these approaches has been achieving reliable operation. In practice, reliability is limited by the small forces produced at the switch contacts. For optimal operation, closure of the switch contacts should be maintained by the highest possible force. In the prior art, acceptable contact forces have proven difficult to obtain.

SUMMARY OF THE INVENTION

The present invention provides a miniature relay which is thermomagnetically actuated. In accordance with the preferred embodiment, a permanent magnet supports a substrate which carries contact points. Mating contact points are provided on a moving element which is magnetically held against the substrate, but is free to pivot in response to magnetic flux density changes. Heaters on the substrate are used to control the temperature of fixed ferromagnetic elements, which cause the magnetic flux density to change when power is applied to the heater. The resulting flux density change causes the moving element to pivot, thus making and breaking connections as desired. Magnetic forces produce acceptable switch contact forces and permit latching operation. No magnetic coils need be used, which avoids complexity of design and manufacture.

DESCRIPTION OF THE PREFERRED EMBODIMENT

Figure 1:
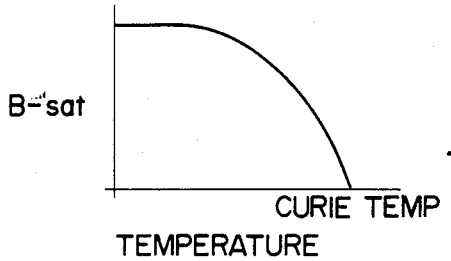
FIG. 1 is a plot of saturation flux density versus temperature for a ferromagnetic material.

The preferred embodiment of the present invention is designed to exploit a property of ferromagnetic materials which is illustrated by the graph shown in FIG. 1. The saturation flux density (B-sat) of a ferromagnetic material typically falls with increasing temperature, as indicated on the graph. The curve shown is representative of many materials, and in particular, shows the behavior of nickel iron alloy (NiFe). By heating a ferromagnetic material, the saturation flux density may be adjusted at will. In the preferred embodiment, this property permits the flux, and thus the magnetic force, in a gap to be thermally controlled, which causes a pivoting element to make connections as desired.

Figure 2:
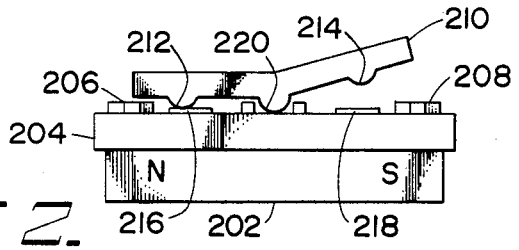
FIG. 2 is a side view of a thermomagnetic relay according to the invention.

One embodiment of the invention is shown in FIG. 2. A permanent magnet 202 supports a substrate 204. Magnet 202 may be, for example, Alnico 5–7, while substrate 204 may be Forsterite. Other materials may be used for substrate 204, but low thermal conductivity is desirable for energy efficient operation of the relay. The dielectric constant (preferrably comparable to that of Forsterite) and the suitability of the material for being printed upon are also important factors in material choice.

Heated elements 206 and 208 rest on substrate 204. In the preferred embodiment, these elements are heated by thick film resistors printed on substrate 204. Elements 206 and 208 are formed of a ferromagnetic material such as NiFe alloy, which may be attached to the substrate with a high thermal conductivity epoxy. NiFe is suggested for its high saturation flux density and low Curie point temperature, although other materials with similar characteristics may be used. Chemical milling may be used to form the elements of NiFe.

A moving element 210 is magnetically held against the substrate 204 by the magnetic attraction between moving element 210 and permanent magnet 202. Element 210 should be made from a material having high permeability and high saturation flux density, which is suitable for being plated and capable of being accurately shaped for dimensional control. A 30% NiFe alloy is suitable. Closed die coining may be used to fabricate moving element 210 from this material, although high forming pressures are required. Alternatively, powder metallurgy techniques may be used with a die, at the expense of somewhat greater difficulty in later plating of the element.

Plated contact points 212 and 214 are provided on moving element 210 for forming connections with contacts 216 and 218 on the substrate. Item 220 is a pivot point for the moving element.

Operation of the relay entails causing the rigid moving element to rock on its pivot point from one side to the other. Assuming that the relay is in the position illustrated in FIG. 2, the proper action may be induced by applying current to the heater (thick film resistor) underlying element 206. As the temperature of element 206 rises, its saturation flux density falls in accordance with the graph in FIG. 1. This reduces the flux in the air gap between element 206 and the end of moving element 210, which in turn affects the force holding contacts 212 and 216 together. The temperature increases until the force of attraction at the other side of the relay exceeds the force holding the closed side. At this point, the moving element 210 begins to rock about pivot point 220. The magnetic forces on the two sides of moving element 210 produce a positive feedback effect, and the element snaps into a position which is a mirror image of that shown in FIG. 2. This closes contact points 214 and 218, while opening contacts 212 and 216.

The heater may then be turned off, and moving element 210 will remain in place. The relay thus latches, with a stable position for moving element 210 at each extreme of its rocking action. High contact forces may be achieved, and a suitably low energy is required to switch the relay from one state to the other. Heating element 208 will return the relay to its former state.

Figure 3:
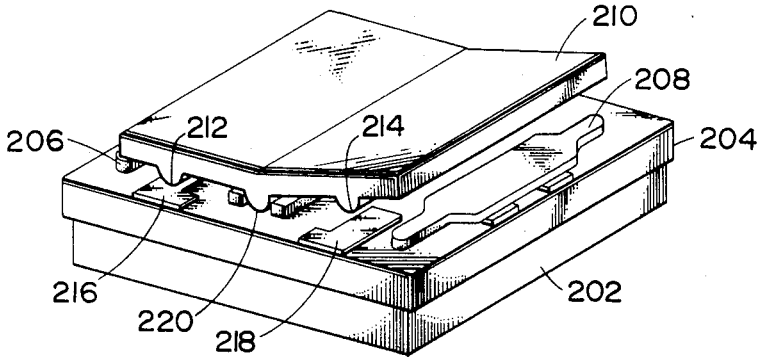
FIG. 3 is a perspective view of a relay according to the invention.

A perspective view of one embodiment of the invention is provided in FIG. 3. Items in FIG. 3 bear reference numbers corresponding to same-numbered elements in FIG. 2. This embodiment is suitable for planar fabrication at low cost. Small physical dimensions may be achieved as well. For example, the embodiment of FIG. 3 may be produced with substrate dimensions of 0.150" by 0.120", with a combined height of the magnet and substrate of about 0.060".

Figure 4:
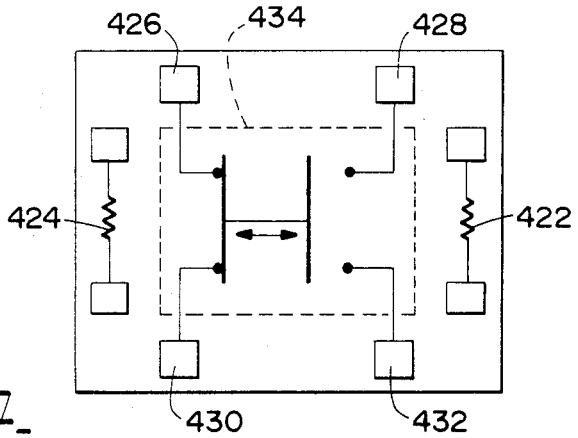
FIG. 4 is a diagram of a pad layout for relays such as that shown in FIG. 3.

A suitable pad configuration for relays such as that shown in FIG. 3 is depicted in the diagram in FIG. 4. This diagram also shows the electrical functionality of the relay. Control signals are delivered to the heaters represented by schematic resistor symbols 422 and 424, while signals to be switched by the relay are provided via 426, 428, 430, and 432. The relay switching function is also shown schematically as 434.

The preferred embodiments provide small, low cost, latching relays, without the need for any magnetic coils. High contact forces are produced, yielding reliable operation. An alternate embodiment might also include having heater resistors 422 and 424 printed directly on heated elements 206 and 208. Additionally, moving element 210 could be made a permanent magnet and permanent magnet 202 a suitable magnetic material.

We claim:

1. A thermomagnetic relay comprising:

a plate of a hard magnetic material;

a substrate mounted on the plate;

a plurality of contact points on the substrate for forming electrical connections;

a moving element of a ferromagnetic material pivotably positioned on the substrate having contact points for selectively forming electrical interconnections of preselected ones of said contact points;

first and second ferromagnetic elements positioned on the substrate adjacent opposite ends of said moving element; and first and second thermal means for selectively altering the temperature of said first and second ferromagnetic elements;

one of said plate and said moving element includes a permanent magnet with said moving element being affixed to said substrate by magnetic attraction.

2. A thermomagnetic relay as in claim 1 wherein the first and second thermal means are thick film resistors printed on the substrate.

3. A thermomagnetic relay as in claim 1 wherein the first and second thermal means are thick film resistors printed on said first and second ferromagnetic elements.

4. A thermomagnetic relay as in claim 1 wherein the moving element comprises:

a first substantially planar segment;

a second substantially planar segment which rigidly intersects the first substantially planar segment at an obtuse angle; and a plurality of projections for carrying contact points.

5. A thermomagnetic relay as in claim 4 wherein the first and second ferromagnetic elements are composed of a nickel iron alloy.

6. A thermomagnetic relay as in claim 4 wherein the plate is a permanent magnet.

7. A thermomagnetic relay as in claim 1, wherein the first and second thermal means comprise respective heater means for selectively heating the first and second ferromagnetic elements.

* * * * *